US012365434B2

(12) United States Patent
Hikosaka

(10) Patent No.: US 12,365,434 B2
(45) Date of Patent: Jul. 22, 2025

(54) OUTBOARD MOTOR

(71) Applicant: SUZUKI MOTOR CORPORATION, Hamamatsu (JP)

(72) Inventor: Tomokazu Hikosaka, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 472 days.

(21) Appl. No.: 18/081,274

(22) Filed: Dec. 14, 2022

(65) Prior Publication Data

US 2023/0202629 A1 Jun. 29, 2023

(30) Foreign Application Priority Data

Dec. 23, 2021 (JP) ..... 2021-209509

(51) Int. Cl.
*B63H 20/00* (2006.01)
*B63H 20/32* (2006.01)

(52) U.S. Cl.
CPC ..... *B63H 20/002* (2013.01); *B63H 20/32* (2013.01)

(58) Field of Classification Search
CPC .... B63H 20/002; B63H 20/001; B63H 20/00; B63H 20/32
See application file for complete search history.

(56) References Cited

U.S. PATENT DOCUMENTS

| | | | | |
|---|---|---|---|---|
| 7,086,915 | B2 * | 8/2006 | Hikosaka | B63H 20/002 440/88 L |
| 7,578,713 | B2 * | 8/2009 | Miyata | B63H 20/14 440/75 |
| 10,259,554 | B1 * | 4/2019 | Eichinger | B63H 20/14 |
| 2017/0113772 | A1 | 4/2017 | Kumita | B63H 20/002 |
| 2020/0207452 | A1 | 7/2020 | Sugiyama | B63H 20/002 |

FOREIGN PATENT DOCUMENTS

| | | |
|---|---|---|
| JP | 2017-081372 A | 5/2017 |
| JP | 2020-104573 A | 7/2020 |

* cited by examiner

*Primary Examiner* — Michael L Sehn
(74) *Attorney, Agent, or Firm* — Stein IP, LLC

(57) ABSTRACT

An outboard motor includes a power source disposed, a propeller shaft, a drive shaft, a gear mechanism, a lower case having an internal space in which gear oil is stored, a gear oil gauge configured to check a level or a state of the gear oil stored in the internal space, a gauge mounting hole provided configured to removably mount the gear oil gauge to the lower case such that one end side of the gear oil gauge is immersed in the gear oil stored in the internal space, a gauge insertion portion configured to insert the gear oil gauge into the gauge mounting hole, an oil supply and discharge passage provided in the lower case, and a pump connecting portion configured to connect a pump. The gauge insertion portion and the pump connecting portion are arranged side by side.

5 Claims, 6 Drawing Sheets

OUTBOARD MOTOR

CROSS-REFERENCE TO RELATED APPLICATIONS

The disclosure of Japanese Patent Application No. 2021-209509 filed on Dec. 23, 2021, including specification, drawings and claims is incorporated herein by reference in its entirety.

TECHNICAL FIELD

The present disclosure relates to an outboard motor in whose lower case a gear mechanism is accommodated and gear oil is stored.

BACKGROUND ART

For most outboard motors, a gear mechanism that transmits rotation of a drive shaft to a propeller shaft is accommodated in an internal space of a lower case provided at a lower portion of the outboard motor. In addition, gear oil for lubricating the gear mechanism is stored in the internal space.

Among the outboard motors, there is a type of outboard motor in which a drain bolt is provided in a lower portion of a lower case, gear oil stored in an internal space of the lower case is discharged to the outside of the outboard motor through a mounting hole of the drain bolt, and gear oil is injected into the internal space of the lower case from the outside of the outboard motor through the mounting hole of the drain bolt. Many small-sized outboard motors are of this type. On the other hand, among the outboard motors, there is a type of outboard motor in which an oil supply and discharge passage for discharging gear oil stored in an internal space of a lower case to the outside of the outboard motor or supplying gear oil from the outside of the outboard motor to the internal space is provided, and an oil pump is connected to the oil supply and discharge passage to perform suction or injection of gear oil. There is a medium-sized or large-sized outboard motor of this type. The following Patent Literatures 1 and 2 disclose the latter type of outboard motor.

Patent Literature 1: JP2017-81372A

Patent Literature 2: JP2020-104573A

An outboard motor in the related art is provided with a gauge for checking a level of engine oil, but is not provided with a gauge for checking a level or state of gear oil. If the outboard motor is provided with a gauge for checking the level (storage amount) or the state (contamination degree or the like) of the gear oil, it is easy to check the level or the state of the gear oil. Accordingly, a user can check on a daily basis whether the gear oil needs to be replaced, and thus the outboard motor can be managed finely and the safety of navigation can be enhanced.

When it is determined, as a result of the user checking the state of the gear oil by using the gauge, that the gear oil needs to be replaced, it would be convenient if an operation of checking the state of the gear oil can be smoothly shifted to an operation of replacing the gear oil. In addition, it would be convenient if an injection amount of the gear oil can be checked using a gauge while the gear oil is being injected into the outboard motor. In order to realize the above, it is desirable that the user can perform insertion and removal of a gauge, connection of an oil pump, an operation on the oil pump, and the like when the user stays at one position near the outboard motor or simply slightly moves near the outboard motor. The present disclosure has been made in view of, for example, the above-described problems, and an object of the present disclosure is to provide an outboard motor for which checking of a level or a state of gear oil and replacement of the gear oil can be easily and smoothly performed.

SUMMARY

In order to solve the above problem, there is provided an outboard motor for propelling a boat, the outboard motor including: a power source disposed at an upper portion of the outboard motor; a propeller shaft disposed at a lower portion of the outboard motor, to which a propeller is mounted; a drive shaft provided between the power source and the propeller shaft and configured to be rotated by a rotational output of the power source; a gear mechanism disposed at the lower portion of the outboard motor and configured to transmit rotation of the drive shaft to the propeller shaft; a lower case disposed at the lower portion of the outboard motor and having an internal space in which the gear mechanism is accommodated and in which gear oil for lubricating the gear mechanism is stored; a gear oil gauge configured to check a level or a state of the gear oil stored in the internal space; a gauge mounting hole provided in the lower case and configured to removably mount the gear oil gauge to the lower case such that one end side of the gear oil gauge is immersed in the gear oil stored in the internal space; a gauge insertion portion configured to insert the gear oil gauge into the gauge mounting hole; an oil supply and discharge passage provided in the lower case and configured to discharge gear oil from an inside of the internal space to an outside of the outboard motor or to supply gear oil from the outside of the outboard motor to the inside of the internal space; and a pump connecting portion configured to connect a pump, which is configured to supply and discharge gear oil, and the oil supply and discharge passage. The gauge insertion portion and the pump connecting portion are arranged side by side in a front-rear direction at one side portion in a left-right direction of an upper portion of the lower case.

DESCRIPTION OF EMBODIMENTS

Figure 1:
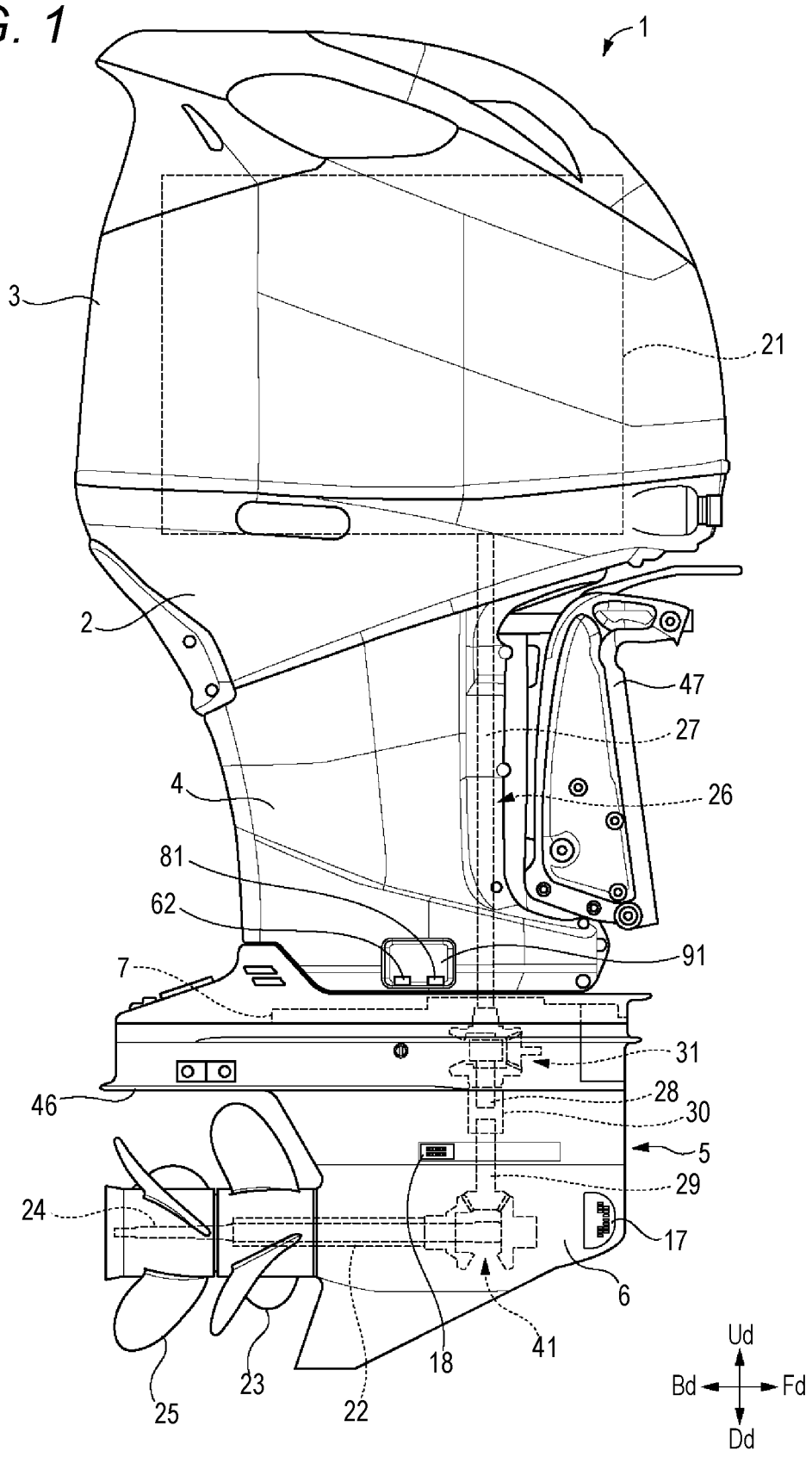
FIG. 1 is a general view illustrating an outboard motor according to an embodiment of the present disclosure.

An outboard motor according to an embodiment of the present disclosure includes a power source that is disposed at an upper portion of the outboard motor, a propeller shaft that is disposed at a lower portion of the outboard motor and to which a propeller is mounted, a drive shaft that is provided between the power source and the propeller shaft and rotates by a rotational output of the power source, a gear mechanism that is disposed at the lower portion of the outboard motor and transmits rotation of the drive shaft to the propeller shaft, and a lower case that is disposed at the lower portion of the outboard motor and has an internal space in which the gear mechanism is accommodated and gear oil for lubricating the gear mechanism is stored.

The outboard motor according to the present embodiment includes a gear oil gauge for checking a level or a state of the gear oil stored in the internal space of the lower case, a gauge mounting hole provided in the lower case and used for removably mounting the gear oil gauge to the lower case such that one end side of the gear oil gauge is immersed in the gear oil stored in the internal space, and a gauge insertion portion used for inserting the gear oil gauge into the gauge mounting hole.

Further, the outboard motor according to the present embodiment includes an oil supply and discharge passage that is provided in the lower case and used for discharging gear oil from an inside of the internal space to an outside of the outboard motor or supplying gear oil from the outside of the outboard motor to the inside of the internal space, and a pump connecting portion that is used for connecting an oil pump, which performs supply and discharge of the gear oil, to the oil supply and discharge passage.

Further, in the outboard motor of the present embodiment, the gauge insertion portion and the pump connecting portion are arranged side by side in a front-rear direction at one side portion in a left-right direction of an upper portion of the lower case.

Since the outboard motor of the present embodiment includes the gear oil gauge, a user can easily check the level or the state of the gear oil stored in the internal space of the lower case by using the gear oil gauge. For example, the user can use the gear oil gauge to check on a daily basis whether the gear oil needs to be replaced, and can manage the outboard motor finely. Accordingly, safety of navigation can be enhanced.

In the outboard motor of the present embodiment, the gauge insertion portion and the pump connecting portion are arranged side by side in the front-rear direction at one side portion in the left-right direction of the upper portion of the lower case. Therefore, the user can perform insertion and removal of the oil gear gauge, connection of the oil pump, an operation on the oil pump, and the like when the user stays at one position on one side in the left-right direction of the outboard motor or simply slightly moves on one side in the left-right direction of the outboard motor. Accordingly, when it is determined, as a result of the user checking the state of the gear oil by using the gear oil gauge, that the gear oil needs to be replaced, it is possible to smoothly shift from an operation of checking the state of the gear oil to an operation of replacing the gear oil. The user can check an injection amount of the gear oil by using the gear oil gauge while injecting the gear oil into the outboard motor. In this way, according to the outboard motor of the present embodiment, it is possible to easily and smoothly perform the checking of the level or the state of the gear oil and the replacement of the gear oil.

Embodiment

An embodiment of an outboard motor according to the present disclosure will be described. In the embodiment, directions of up (Ud), down (Dd), front (Fd), rear (Bd), left (Ld), and right (Rd) are indicated by arrows drawn at the lower right of FIGS. 1 to 6 and 8.

(Outboard Motor)

Figure 2:
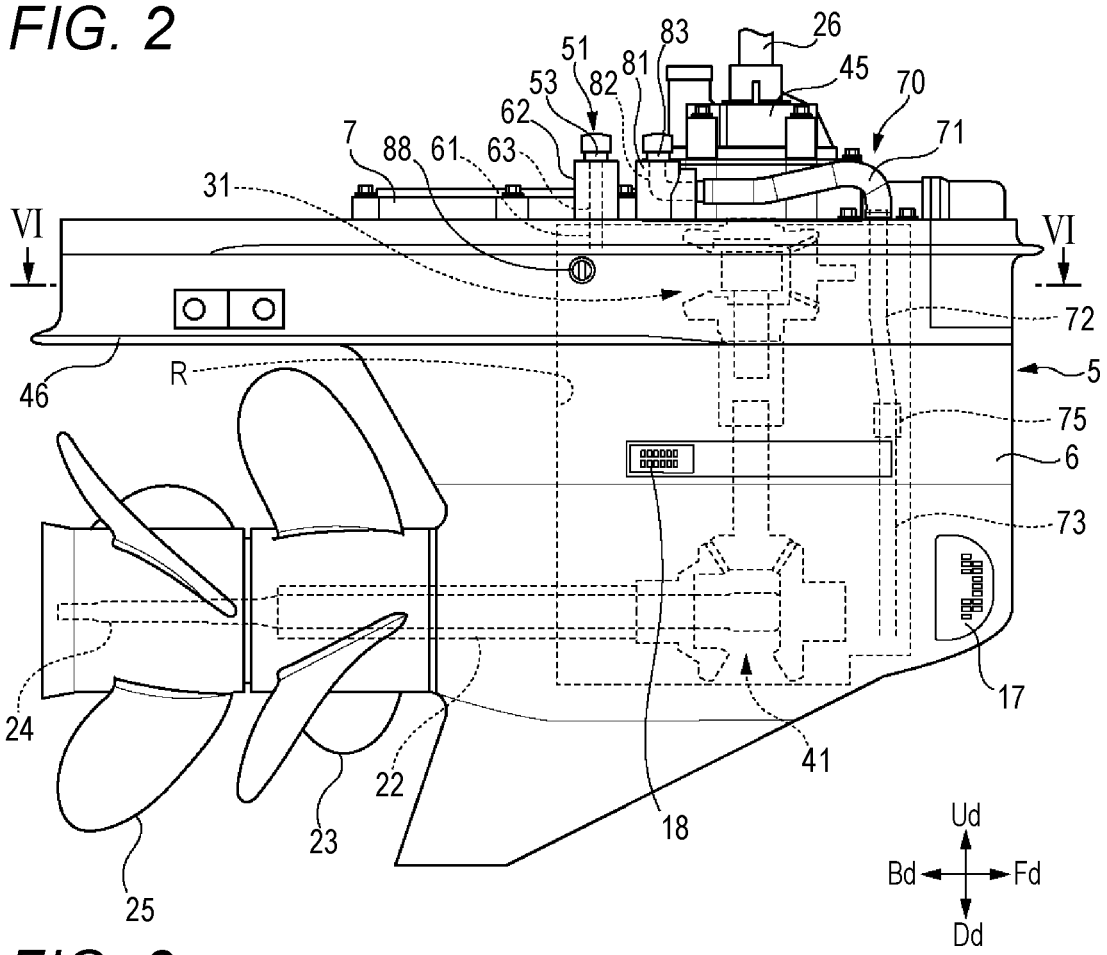
FIG. 2 is an explanatory view illustrating a lower portion of the outboard motor according to the embodiment of the present disclosure as viewed from a right side.
Figure 3:
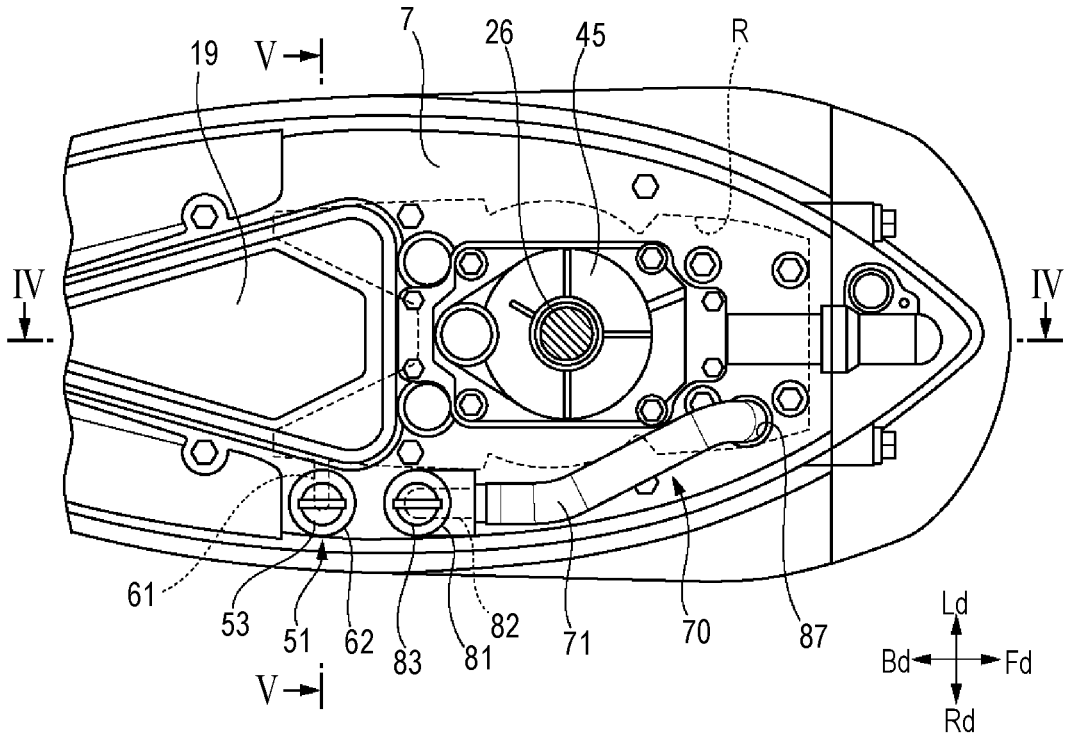
FIG. 3 is an explanatory view illustrating the lower portion of the outboard motor according to the embodiment of the present disclosure as viewed from an upper side.
Figure 4:
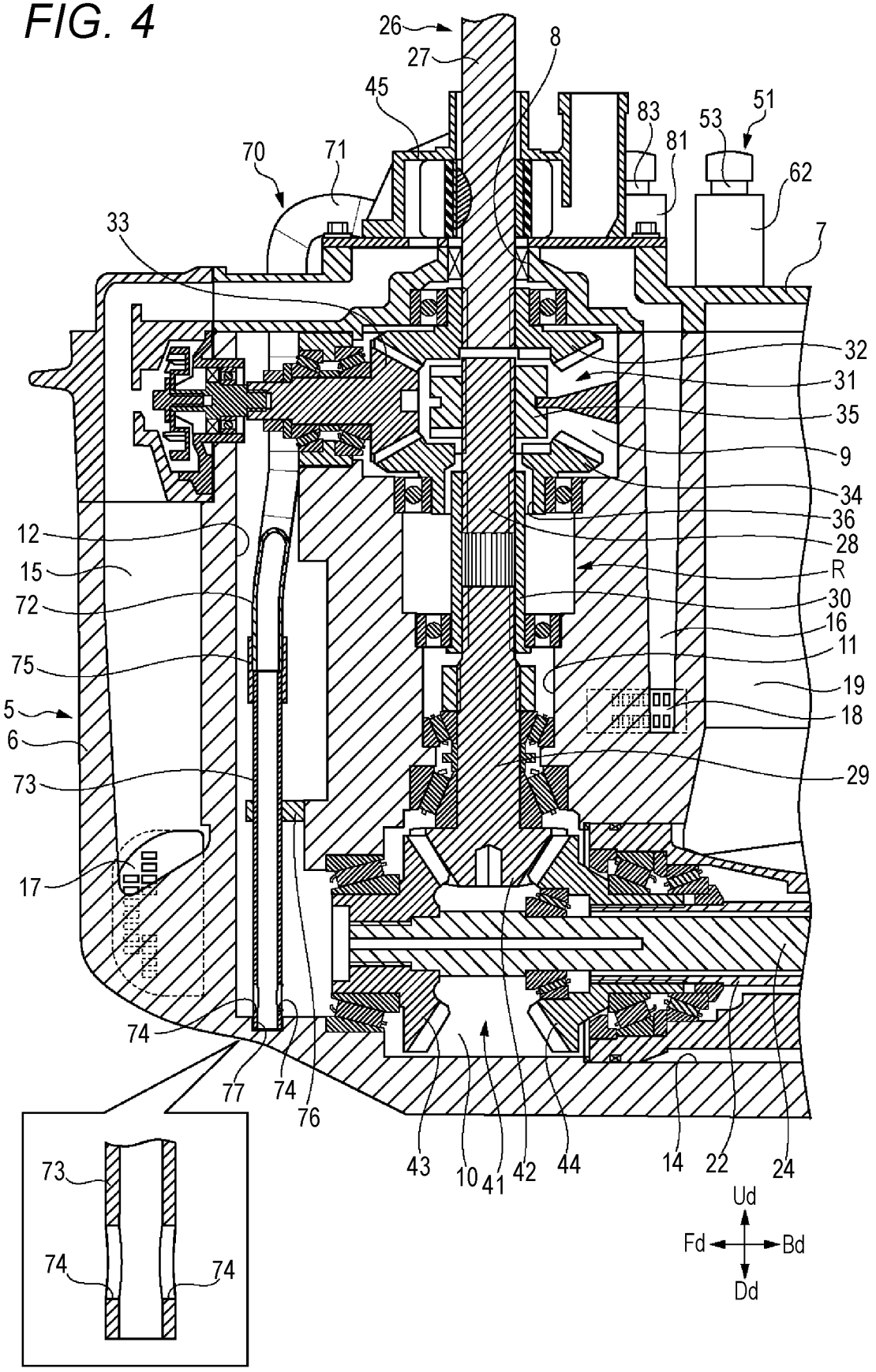
FIG. 4 is a cross-sectional view of a front portion of the lower portion of the outboard motor taken along a cutting line IV-IV in FIG. 3.

FIG. 1 illustrates an entire outboard motor 1 according to an embodiment of the present disclosure as viewed from a right side. FIG. 2 illustrates a lower portion of the outboard motor 1 as viewed from the right side. FIG. 3 illustrates the lower portion of the outboard motor 1 as viewed from an upper side. FIG. 4 illustrates a cross section of the lower portion of the outboard motor 1 taken along a cutting line IV-IV in FIG. 3, as viewed from a left side (from an upper side of the drawing of FIG. 3).

The outboard motor 1 is a device for propelling a boat. As illustrated in FIG. 1, the outboard motor 1 according to the present embodiment adopts a counter-rotating propeller system. The outboard motor 1 includes an engine 21 serving as a power source, an outer propeller shaft 22, a front propeller 23 mounted to the outer propeller shaft 22, an inner propeller shaft 24 provided at an inner side of the outer propeller shaft 22, a rear propeller 25 mounted to the inner propeller shaft 24, a drive shaft 26 rotated by a rotational output of the engine 21, and an upper gear mechanism 31 and a lower gear mechanism 41 that transmit the rotation of the drive shaft 26 to the propeller shafts 22 and 24. The outer propeller shaft 22 and the inner propeller shaft 24 are specific examples of a "propeller shaft", and the front propeller 23 and the rear propeller 25 are specific examples of a "propeller". The upper gear mechanism 31 and the lower gear mechanism 41 are specific examples of a "gear mechanism".

The engine 21 is disposed at an upper portion of the outboard motor 1, and the propeller shafts 22 and 24 are disposed at a lower portion of the outboard motor 1. The drive shaft 26 extends in an up-down direction from the engine 21 toward the lower portion of the outboard motor 1. The drive shaft 26 is divided into an upper shaft portion 27, an intermediate shaft portion 28, and a lower shaft portion 29. An upper end portion of the upper shaft portion 27 is connected to the engine 21. The intermediate shaft portion 28 and the lower shaft portion 29 are coupled to each other by a coupling member 30. The upper gear mechanism 31 is provided between the upper shaft portion 27 and the intermediate shaft portion 28. The lower gear mechanism 41 is disposed at the lower portion of the outboard motor 1.

The engine 21 is covered with a bottom cowl 2 and a top cowl 3. The upper shaft portion 27 is covered with an upper case 4. The upper gear mechanism 31, the intermediate shaft portion 28, the coupling member 30, the lower shaft portion 29, the lower gear mechanism 41, and front portions of the propeller shafts 22 and 24 are covered with a lower case 5. The lower case 5 is located at a lower side of the upper case 4, and is fitted to and connected to the upper case 4.

As illustrated in FIGS. 2 to 4, the lower case 5 includes a lower case body 6 that is formed in a substantially box shape with an open upper portion, and a lid member 7 that covers the upper portion of the lower case body 6. As illustrated in FIG. 4, a drive shaft insertion hole 8 is formed in the lid member 7. An upper gear chamber 9 is provided at a front upper portion in the lower case 5. The drive shaft insertion hole 8 communicates with the upper gear chamber 9. A lower gear chamber 10 is provided at a front lower portion in the lower case 5. A connection hole 11 is provided between the upper gear chamber 9 and the lower gear chamber 10 in the lower case 5 to connect the upper gear chamber 9 and the lower gear chamber 10. In the lower case 5, a supply and discharge passage arrangement hole 12 is provided at a front side of the upper gear chamber 9, the lower gear chamber 10, and the connection hole 11.

The upper shaft portion 27 of the drive shaft 26 is inserted into the drive shaft insertion hole 8. A gap between the upper shaft portion 27 and the drive shaft insertion hole 8 is sealed. The upper gear mechanism 31 is accommodated in the upper gear chamber 9. The intermediate shaft portion 28 and the lower shaft portion 29 of the drive shaft 26, and the coupling member 30 are disposed in the connection hole 11. The lower gear mechanism 41 is accommodated in the lower gear chamber 10. A second supply and discharge pipe 72 and a third supply and discharge pipe 73, which are parts of an oil supply and discharge passage 70 to be described later, are arranged in the supply and discharge passage arrangement hole 12. In the upper gear chamber 9, the connection hole 11, the lower gear chamber 10, and the supply and discharge passage arrangement hole 12, gear oil for lubricating a plurality of gears, a plurality of bearings, and the like provided in the upper gear mechanism 31 and the lower gear mechanism 41 is stored. Hereinafter, in the lower case 5, a space for storing the gear oil, that is, the upper gear chamber 9, the connection hole 11, the lower gear chamber 10, and the supply and discharge passage arrangement hole 12 are referred to as an "oil storage space R". The oil storage space R is a specific example of an "internal space".

In the lower case 5, a propeller shaft arrangement hole 14 is formed at a rear side of the lower gear chamber 10. The front portions of the propeller shafts 22 and 24 are arranged in the propeller shaft arrangement hole 14. In the lower case 5, a main water intake passage 15 is provided at a front side of the supply and discharge passage arrangement hole 12. In the lower case 5, a sub-water intake passage 16 is provided at a rear side of the upper gear chamber 9 and the connection hole 11. The main water intake passage 15 and the sub-water intake passage 16 are passages through which water such as seawater or lake water taken in from a main water intake port 17 and a sub-water intake port 18 flows. The water is used as cooling water for cooling the engine 21 and the like. In the lower case 5, an exhaust passage 19 is provided at a rear side of the sub-water intake passage 16. The exhaust passage 19 is a passage for discharging exhaust gas discharged from the engine 21 to the outside of the outboard motor 1. The propeller shaft arrangement hole 14, the main water intake passage 15, the sub-water intake passage 16, and the exhaust passage 19 are sealed by a seal member or isolated from the oil storage space R by a partition wall, so that the gear oil in the oil storage space R does not leak to any of the propeller shaft arrangement hole 14, the main water intake passage 15, the sub-water intake passage 16, and the exhaust passage 19.

The upper gear mechanism 31 accommodated in the upper gear chamber 9 of the lower case 5 is a mechanism that switches rotation directions of the propeller shafts 22 and 24 by switching rotation directions of the intermediate shaft portion 28 with respect to the upper shaft portion 27. The upper gear mechanism 31 includes a reverse drive gear 32, a reverse intermediate gear 33, a reverse output gear 34, and a clutch 35.

The reverse drive gear 32, the reverse intermediate gear 33, and the reverse output gear 34 are bevel gears, and are rotatably supported by the lower case 5 via bearings. The reverse drive gear 32 is coupled to a lower end portion of the upper shaft portion 27 and rotates integrally with the upper shaft portion 27. The reverse intermediate gear 33 rotates about an axis perpendicular to an axis of the upper shaft portion 27. The reverse output gear 34 rotates about the same axis as the upper shaft portion 27. The reverse drive gear 32 meshes with the reverse intermediate gear 33, and the reverse intermediate gear 33 meshes with the reverse output gear 34. The upper shaft portion 27 rotates in a forward direction by the rotational output of the engine 21. Therefore, the reverse drive gear 32 also rotates in the forward direction. When the rotation of the reverse drive gear 32 is transmitted to the reverse output gear 34 via the reverse intermediate gear 33, the reverse output gear 34 rotates in a reverse direction with respect to the forward rotation of the reverse drive gear 32.

The clutch 35 is a dog clutch and is disposed between the reverse drive gear 32 and the reverse output gear 34. The clutch 35 is coupled to an upper-end-side portion of the intermediate shaft portion 28, which enters between the reverse drive gear 32 and the reverse output gear 34 through a through hole 36 of the reverse output gear 34, so as to be immovable in a circumferential direction but movable in an axial direction with respect to the intermediate shaft portion 28. Accordingly, the clutch 35 and the intermediate shaft portion 28 rotate integrally, and the clutch 35 can move in the up-down direction with respect to the intermediate shaft portion 28. Further, a lower end side of the intermediate shaft portion 28 passes through the through hole 36 provided in a central portion of the reverse output gear 34, and extends to a lower side of the reverse output gear 34. The intermediate shaft portion 28 is not in contact with the through hole 36, and can rotate independently of the reverse output gear 34.

The clutch 35 is moved in the up-down direction by an operation of an actuator (not illustrated). When the clutch 35 is moved to an upper side, a clutch pawl formed on an upper end surface of the clutch 35 engages with a clutch pawl formed on a lower end surface of the reverse drive gear 32. Accordingly, the rotation of the reverse drive gear 32 in the forward direction is directly transmitted to the intermediate shaft portion 28, and the intermediate shaft portion 28 rotates in the forward direction. On the other hand, when the clutch 35 is moved to a lower side, a clutch pawl formed on a lower end surface of the clutch 35 engages with a clutch pawl formed on an upper end surface of the reverse output gear 34. Accordingly, the rotation of the reverse output gear 34 in the reverse direction is transmitted to the intermediate shaft portion 28, and the intermediate shaft portion 28 rotates in the reverse direction.

The intermediate shaft portion 28 and the lower shaft portion 29 are arranged coaxially with the upper shaft portion 27. The intermediate shaft portion 28 and the lower shaft portion 29 are coupled to each other by the coupling member 30 and rotate integrally. The intermediate shaft portion 28 and the lower shaft portion 29, which are integrated as described above, are rotatably supported by the connection hole 11 in the lower case 5 via bearings.

The lower gear mechanism 41 accommodated in the lower gear chamber 10 of the lower case 5 is a mechanism that connects a lower end portion of the lower shaft portion 29 and front end portions of the propeller shafts 22 and 24. The gear mechanism 41 includes a main drive gear 42, a front driven gear 43, and a rear driven gear 44. The main drive gear 42, the front driven gear 43, and the rear driven gear 44 are bevel gears. The main drive gear 42 is coupled to the lower end portion of the lower shaft portion 29 and rotates integrally with the lower shaft portion 29. The front driven gear 43 and the rear driven gear 44 are disposed at a front side and a rear side of the main drive gear 42 respectively, and mesh with the main drive gear 42. Each of the front driven gear 43 and the rear driven gear 44 is rotatably supported by the lower case body 6 via a bearing. The front driven gear 43 is coupled to the front end portion of the inner propeller shaft 24, and accordingly the front driven gear 43 and the inner propeller shaft 24 rotate integrally. The rear driven gear 44 is coupled to the front end portion of the outer propeller shaft 22, and accordingly the rear driven gear 44 and the outer propeller shaft 22 rotate integrally.

When the main drive gear 42 rotates integrally with the lower shaft portion 29, the rotation is transmitted to the front driven gear 43 and the rear driven gear 44. As a result, the inner propeller shaft 24 and the outer propeller shaft 22 rotate. At this time, rotation directions of the inner propeller shaft 24 and the outer propeller shaft 22 are opposite to each other. As the inner propeller shaft 24 and the outer propeller shaft 22 rotate, the rear propeller 25 and the front propeller 23 rotate correspondingly. When the rotation of the upper shaft portion 27 in the forward direction is transmitted to the propeller shafts 22 and 24 via the intermediate shaft portion 28, the lower shaft portion 29, the lower gear mechanism 41, and the like by using the clutch 35, a propulsive force for moving the boat forward is generated by the propellers 23 and 25. When the rotation of the reverse output gear 34 in the reverse direction is transmitted to the propeller shafts 22 and 24 via the intermediate shaft portion 28, the lower shaft portion 29, the lower gear mechanism 41, and the like by using the clutch 35, a propulsive force for moving the ship backward is generated by the propellers 23 and 25.

The outboard motor 1 further includes a cooling water pump 45. The cooling water pump 45 is a device that takes in water such as seawater or lake water via the main water intake passage 15 and the sub-water intake passage 16 and supplies the taken water as cooling water to the engine 21 and the like in order to cool the engine 21 and the like. As illustrated in FIG. 4, the cooling water pump 45 is disposed at an outer peripheral side of the upper shaft portion 27, and is driven by the rotation of the upper shaft portion 27. The cooling water pump 45 is mounted on the lid member 7 of the lower case 5.

As illustrated in FIG. 2, an anti-cavitation plate 46 that prevents air from being drawn toward the propellers 23 and 25 is provided at a rear upper portion of the lower case body 6. As illustrated in FIG. 1, in the outboard motor 1, a clamp bracket 47 for mounting the outboard motor 1 to a transom of a boat is provided at a front side of the upper case 4. Although not illustrated in the drawings, the outboard motor 1 includes a tilt-trim device with which the outboard motor 1 can be tilted (tilt-trim) in a front-rear direction with respect to the clamp bracket 47. The tilt-trim device is provided with a hydraulic or electric actuator for changing a tilt angle (tilt-trim angle) of the outboard motor 1.

(Gear Oil Gauge)

Figure 5:
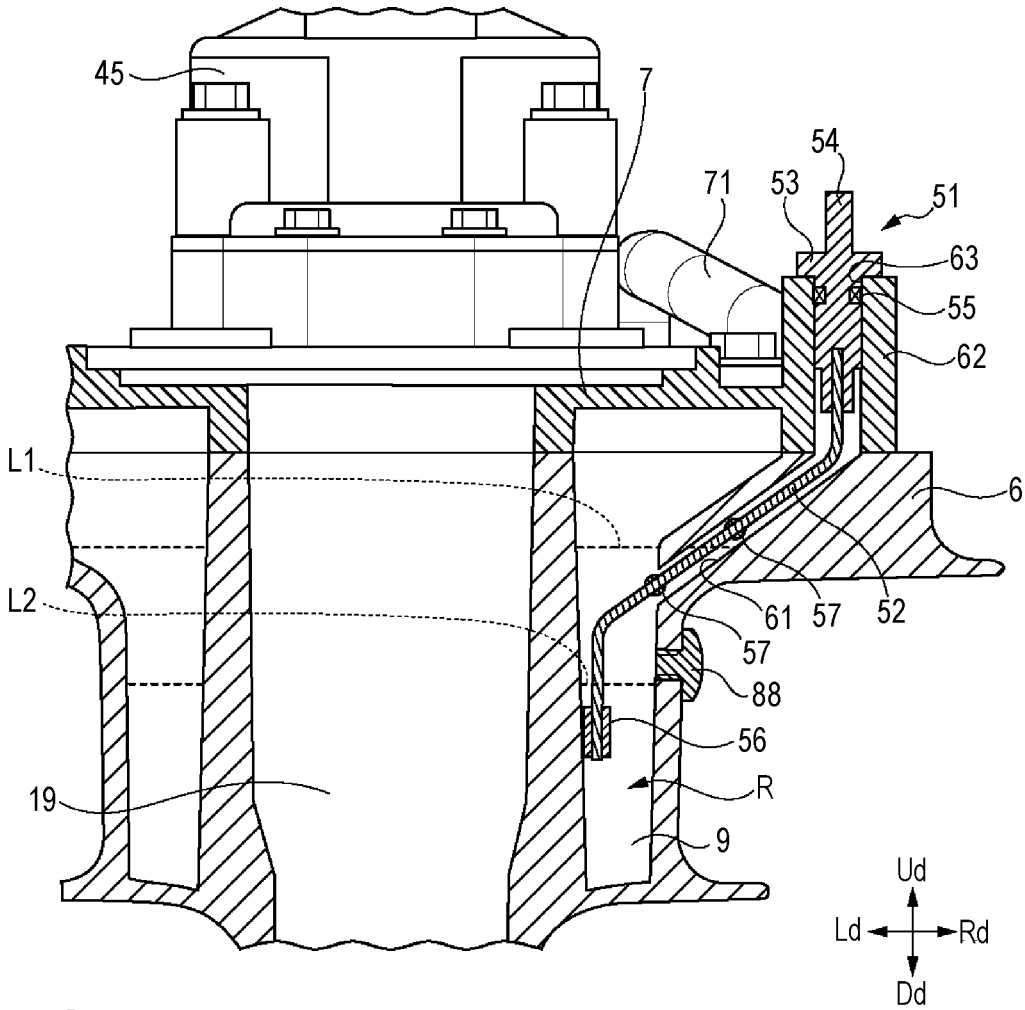
FIG. 5 is a cross-sectional view of a right portion of the lower portion of the outboard motor taken along a cutting line V-V in FIG. 3.
Figure 6:
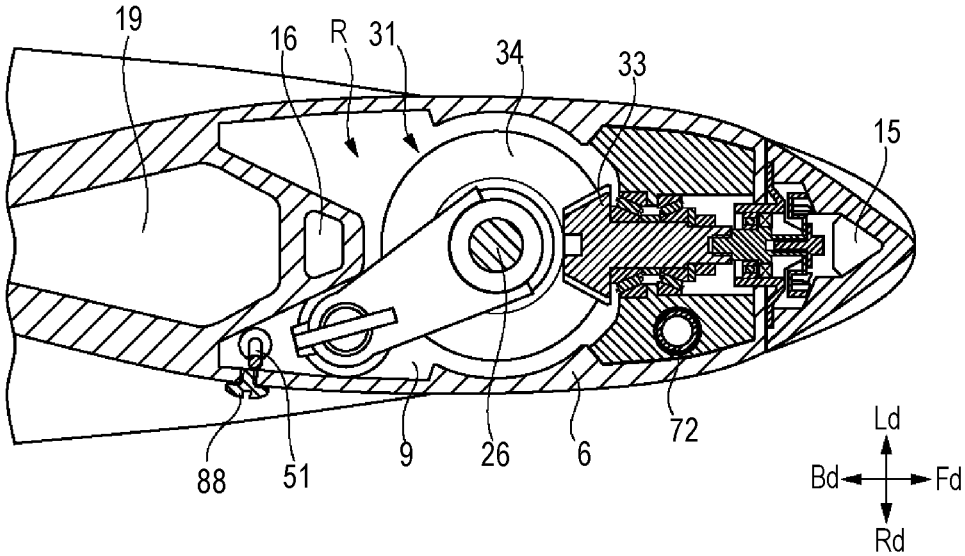
FIG. 6 is a cross-sectional view of the lower portion of the outboard motor taken along a cutting line VI-VI in FIG. 2.
Figure 7:
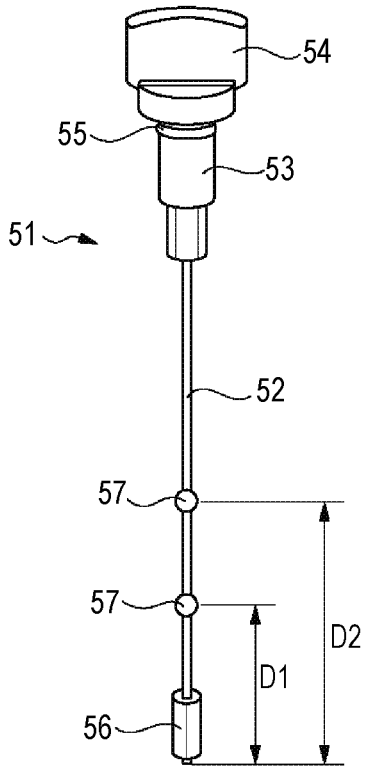
FIG. 7 is an external view illustrating a gear oil gauge in the outboard motor according to the embodiment of the present disclosure.

FIG. 5 illustrates a cross section of the lower portion of the outboard motor 1 taken along a cutting line V-V in FIG. 3, as viewed from a rear side (from an upper side of the drawing of FIG. 3). FIG. 6 illustrates a cross section of the lower portion of the outboard motor 1 taken along a cutting line VI-VI in FIG. 2, as viewed from an upper side. FIG. 7 illustrates a gear oil gauge 51.

As illustrated in FIG. 5, the outboard motor 1 includes the gear oil gauge 51, a gauge mounting hole 61, and a gauge insertion portion 62. The gear oil gauge 51 is an instrument for checking a level (storage amount) or a state (contamination degree or the like) of gear oil stored in the oil storage space R. The gauge mounting hole 61 is a hole for detachably mounting the gear oil gauge 51 to the lower case 5. The gauge insertion portion 62 is a portion for inserting the gear oil gauge 51 into the gauge mounting hole 61.

As illustrated in FIG. 7, the gear oil gauge 51 includes a gauge body 52, a plug 53, a magnet 56, and marks 57. The gauge body 52 is made of, for example, a metal material in an elongated rod shape. Further, the gauge body 52 can be elastically deformed. Specifically, when the gear oil gauge 51 is mounted in the gauge mounting hole 61, the gear oil gauge 51 is bent as illustrated in FIG. 5, and when the gear oil gauge 51 is removed from the gauge mounting hole 61, the gear oil gauge 51 becomes linear as illustrated in FIG. 7. The gauge body 52 is, for example, a metal wire having elasticity. Further, a length of the gauge body 52 is set to a predetermined length so that, when the gear oil gauge 51 is mounted in the gauge mounting hole 61 in a state where an appropriate amount of the gear oil is stored in the oil storage space R, a lower-end-side portion of the gauge body 52 is immersed in the gear oil stored in the oil storage space R.

The plug 53 is a member having a function of holding the gear oil gauge 51 to the gauge insertion portion 62 and a function of closing a gauge insertion hole 63 provided in the gauge insertion portion 62. The plug 53 is made of resin, rubber, or the like. The plug 53 is fixed to an upper end portion of the gauge body 52. A tab 54 is provided on an upper portion of the plug 53. Further, an O-ring 55 made of rubber or the like is provided on an outer peripheral portion of the plug 53.

The magnet 56 is a magnet for attracting iron powder in the gear oil stored in the oil storage space R. The iron powder may diffuse into the gear oil due to an abnormality of the gear mechanisms 31 and 41 or the like. In this case, the iron powder is attracted onto the magnet 56. It is possible to know that an abnormality occurs in the gear mechanisms 31 and 41 or the like, based on an attracted state of the iron powder. The magnet 56 is provided at a lower end portion of the gauge body 52. When the gear oil gauge 51 is mounted in the gauge mounting hole 61 in a state where an appropriate amount of gear oil is stored in the oil storage space R, the magnet 56 is immersed in the gear oil stored in the oil storage space R.

The mark 57 is a mark that functions as a scale for measuring the level of the gear oil stored in the oil storage space R. The mark 57 is made of metal, resin, or the like in a spherical shape. For example, a hole is provided in the mark 57, and the gauge body 52 passes through the hole. The mark 57 is fixed to the gauge body 52. In the present embodiment, two marks 57 are provided on the gauge body 52. Each mark 57 is arranged at a predetermined position between the plug 53 and the magnet 56 on the gauge body 52. A distance D1 between a lower end of the gauge body 52 and the lower mark 57 and a distance D2 between the lower end of the gauge body 52 and the upper mark 57 are respectively set to predetermined values.

As illustrated in FIG. 3, the gauge mounting hole 61 is provided in a right portion (one side portion in the left-right direction) of an upper portion of the lower case body 6. As illustrated in FIG. 2, the gauge mounting hole 61 is provided at an intermediate portion of the lower case body 6 in the front-rear direction, specifically, at a rear side of the drive shaft 26 in a side view of the outboard motor 1. As illustrated in FIG. 5, the gauge mounting hole 61 is an elongated hole, and has a diameter at which the gauge body 52, the magnet 56, and the mark 57 of the gear oil gauge 51 can pass. The gauge mounting hole 61 extends in the up-down direction and is inclined in the left-right direction such that a lower end of the gauge mounting hole 61 is positioned to the left of an upper end of the gauge mounting hole 61. The upper end of the gauge mounting hole 61 is open to an upper surface of the lower case body 6. The lower end of the gauge mounting hole 61 is open to an inner surface of the lower case body 6 facing the oil storage space R, and communicates with the inside of the oil storage space R.

The gauge insertion portion 62 has a function as a pedestal for guiding the gear oil gauge 51 into the gauge mounting hole 61 and for holding the gear oil gauge 51 in the gauge mounting hole 61. Similarly to the gauge mounting hole 61, the gauge insertion portion 62 is provided at an intermediate portion in the front-rear direction of the right portion of the upper portion of the lower case body 6 (at the rear side of the drive shaft 26). The gauge insertion portion 62 is provided on the lid member 7 of the lower case 5 and protrudes to the upper side from the lid member 7. The gauge insertion portion 62 is formed, for example, in a columnar shape having an axis extending in the up-down direction, and the gauge insertion hole 63 is formed in the center of the gauge insertion portion 62. The gauge insertion hole 63 passes through the gauge insertion portion 62 and the lid member 7 in the up-down direction. The gauge insertion portion 62 is disposed at an upper side of the upper end of the gauge mounting hole 61, and the gauge insertion hole 63 communicates with the gauge mounting hole 61. A diameter of the gauge insertion hole 63 is set to be equal to or larger than the diameter of the gauge mounting hole 61, for example. The diameter of the gauge insertion hole 63 is set such that the plug 53 of the gear oil gauge 51 is fitted to the gauge insertion hole 63.

As illustrated in FIG. 5, the gear oil gauge 51 is mounted to the gauge mounting hole 61 by sequentially inserting the gauge body 52 into the gauge insertion hole 63 and the gauge mounting hole 61 from the lower end of the gauge body 52. The gear oil gauge 51 is mounted to the gauge mounting hole 61 in a state where the gauge body 52 is bent. The gear oil gauge 51 is held to the gauge insertion portion 62 by fitting the plug 53 into the gauge insertion hole 63 from above. That is, when the plug 53 is fitted into the gauge insertion hole 63, the O-ring 55 is pressed between the plug 53 and an inner surface of the gauge insertion hole 63 and is in strong contact with the inner surface of the gauge insertion hole 63. Accordingly, the plug 53 is retained in the gauge insertion hole 63, and the gear oil gauge 51 is held to the gauge insertion portion 62. Further, since the O-ring 55 comes into contact with the inner surface of the gauge insertion hole 63, a gap between the plug 53 and the gauge insertion hole 63 is sealed. When the gear oil gauge 51 is mounted to the gauge mounting hole 61 in this manner, the lower-end-side portion of the gauge body 52 and the magnet 56 come out from the lower end of the gauge mounting hole 61 and enter the oil storage space R. When an appropriate amount of gear oil is stored in the oil storage space R, the lower-end-side portion of the gauge body 52 and the magnet 56 are immersed in the gear oil stored in the oil storage space R. As illustrated in FIG. 5, the lower-end-side portion of the gauge body 52 and the magnet 56 are immersed in the gear oil at a position on the right rear side of the upper gear chamber 9 in the oil storage space R.

L1 in FIG. 5 indicates a level of the gear oil (a position of an oil surface thereof) at the time when a tilt angle of the outboard motor 1 with respect to a horizontal direction is 0 degree in a state where an appropriate amount of the gear oil is stored in the oil storage space R. The level L1 of the gear oil at this time is, for example, a position between the two marks 57 in the gear oil gauge 51 mounted to the gauge mounting hole 61. Further, L2 in FIG. 5 indicates the level of the gear oil at the time when a tilt angle of the outboard motor 1 with respect to the horizontal direction is a predetermined tilt angle at suction or injection of the gear oil in a state where an appropriate amount of the gear oil is stored in the oil storage space R. The level L2 of the gear oil at this time is, for example, a position between the lower mark 57 and the magnet 56 in the gear oil gauge 51 mounted to the gauge mounting hole 61.

A user can pull out the gear oil gauge 51 from the gauge mounting hole 61 and the gauge insertion portion 62 by pinching and pulling the tab 54 provided in the plug 53 of the gear oil gauge 51. Thereafter, the user can know the level and the state of the gear oil stored in the oil storage space R by observing the gear oil adhered to the lower-end-side portion of the gauge body 52. In addition, the user can check whether an abnormality occurs in the gear mechanisms 31 and 41 or the like by observing the attracted state of the iron powder attracted to the magnet 56.

(Oil Supply and Discharge Passage)

As illustrated in FIGS. 2 to 4, the outboard motor 1 includes the oil supply and discharge passage 70 and a pump connecting portion 81. The oil supply and discharge passage 70 is a passage for discharging gear oil from an inside of the oil storage space R to an outside of the outboard motor 1 or supplying gear oil from the outside of the outboard motor 1 to the inside of the oil storage space R. The pump connecting portion 81 is a portion for connecting an oil pump, which performs supply and discharge of the gear oil, to the oil supply and discharge passage 70.

As illustrated in FIG. 3, the pump connecting portion 81 is provided at a right portion of an upper portion of the lower case 5. As illustrated in FIG. 2, the pump connecting portion 81 is provided at an intermediate portion of the lower case 5 in the front-rear direction, specifically, at a rear side of the drive shaft 26 in a side view of the outboard motor 1. The pump connecting portion 81 is provided at a front side of the gauge insertion portion 62. That is, the gauge insertion portion 62 and the pump connection portion 81 are arranged side by side in the front-rear direction at the right portion of the upper portion of the lower case 5 and are adjacent to each other.

Figure 8:
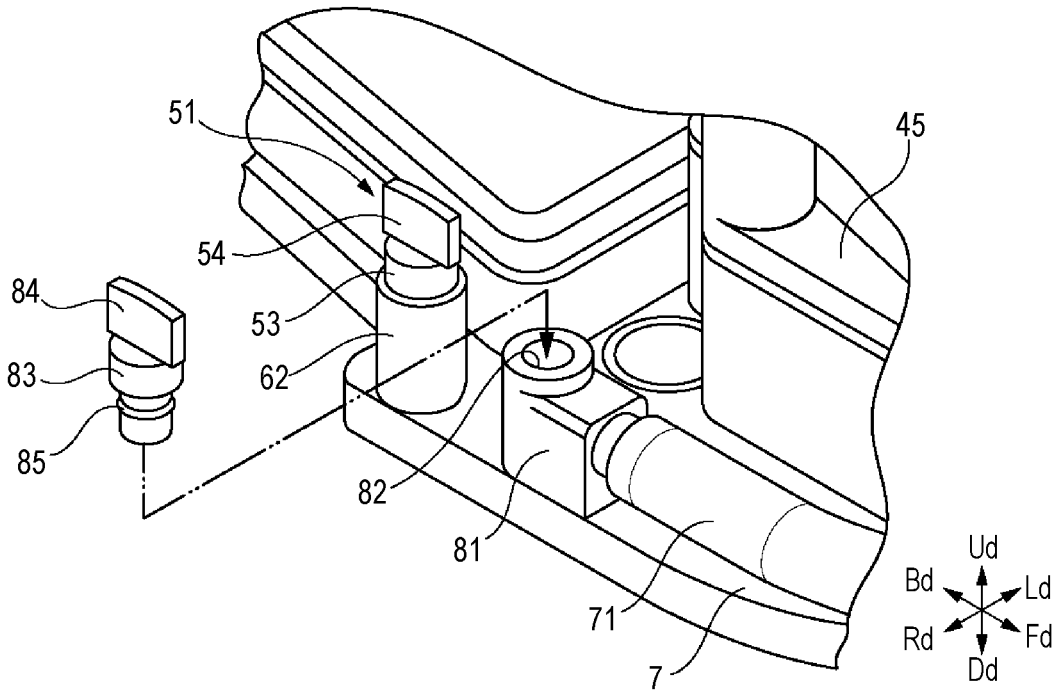
FIG. 8 is a perspective view illustrating a pump connecting portion and the like in the outboard motor according to the embodiment of the present disclosure.

FIG. 8 illustrates a portion of the lower case 5 where the pump connecting portion 81 is provided. As illustrated in FIG. 8, the pump connecting portion 81 is provided on the lid member 7 of the lower case 5 and protrudes to the upper side from the lid member 7. An oil supply and discharge hole 82 is formed in the pump connecting portion 81. One end of the oil supply and discharge hole 82 opens in an upper surface of the pump connecting portion 81, and the other end of the oil supply and discharge hole 82 opens in a front surface of the pump connecting portion 81. In addition, the oil supply and discharge hole 82 is closed by fitting a plug 83 from above the oil supply and discharge hole 82. The plug 83 is made of resin, rubber, or the like, and a tab 84 is provided on an upper portion of the plug 83. Further, an O-ring 85 made of rubber or the like is provided on an outer peripheral portion of the plug 83.

As illustrated in FIGS. 2 to 4, the oil supply and discharge passage 70 includes a first supply and discharge pipe 71, the second supply and discharge pipe 72, and the third supply and discharge pipe 73. As illustrated in FIGS. 2 and 3, the first supply and discharge pipe 71 is disposed above a right front portion of the lid member 7 of the lower case 5. The first supply and discharge pipe 71 is formed of, for example, a flexible hose or tube, or a curved pipe as illustrated in FIGS. 2 and 3. The first supply and discharge pipe 71 extends substantially in the front-rear direction, and a rear end portion of the first supply and discharge pipe 71 is connected to a front end of the oil supply and discharge hole 82 opened in the front surface of the pump connecting portion 81. A front end portion of the first supply and discharge pipe 71 is connected to an upper end portion of the second supply and discharge pipe 72 disposed in a supply and discharge passage introduction hole 87 that is formed in a right portion of a front end portion of the lid member 7 of the lower case 5. The supply and discharge passage introduction hole 87 is a hole that guides the oil supply and discharge passage 70 into the lower case 5, and passes through the lid member 7 in the up-down direction.

As illustrated in FIG. 4, the second supply and discharge pipe 72 is disposed at an upper portion in the supply and discharge passage arrangement hole 12 of the lower case 5. The second supply and discharge pipe 72 is formed of, for example, a flexible hose or tube, or a curved pipe as illustrated in FIG. 4, and extends in the up-down direction. As described above, the upper end portion of the second supply and discharge pipe 72 is disposed in the supply and discharge passage introduction hole 87 and is connected to the front end portion of the first supply and discharge pipe 71. A gap between the upper end portion of the second supply and discharge pipe 72 and the supply and discharge passage introduction hole 87 is sealed.

The third supply and discharge pipe 73 is disposed at a lower portion in the supply and discharge passage arrangement hole 12 in the lower case 5. The third supply and discharge pipe 73 is formed of, for example, a pipe made of metal or resin, and extends linearly in the up-down direction.

An intermediate portion of the third supply and discharge pipe 73 in the up-down direction is supported on a wall portion of the supply and discharge passage arrangement hole 12 via a supply and discharge pipe support member 76 provided in the lower case 5. A lower end portion of the third supply and discharge pipe 73 is inserted into and supported by a support hole 77 provided in a bottom portion of the supply and discharge passage arrangement hole 12 in the lower case body 6.

An upper end portion of the third supply and discharge pipe 73 is connected to a lower end portion of the second supply and discharge pipe 72 via a coupling tube 75. In addition, an oil inlet and outlet 74 is provided in a peripheral wall portion of a portion, which protrudes from the support hole 77, of the lower end portion of the third supply and discharge pipe 73. The lower end portion of the third supply and discharge pipe 73 provided with the oil inlet and outlet 74 is located at a front lower corner portion of the oil storage space R. When sucking the gear oil from the inside of the oil storage space R to be discharged to the outside of the outboard motor 1, or when injecting the gear oil into the inside of the oil storage space R from the outside of the outboard motor 1, the tilt-trim device provided in the outboard motor 1 is operated to tilt the outboard motor 1 forward by a predetermined tilt angle (for example, about 4 degrees to 15 degrees with respect to the horizontal direction). When the outboard motor 1 is tilted forward by a predetermined tilt angle, the front lower corner portion of the oil storage space R is located at the lowermost position of the oil storage space R.

After tilting the outboard motor 1 forward by the predetermined tilt angle, the user connects the oil pump to the pump connecting portion 81, so that the gear oil stored in the oil storage space R can be sucked by the oil pump and discharged to the outside of the outboard motor 1. At this time, the gear oil stored in the oil storage space R flows into the third supply and discharge pipe 73 from the oil inlet and outlet 74 of the third supply and discharge pipe 73, then sequentially flows through the third supply and discharge pipe 73, the second supply and discharge pipe 72, the first supply and discharge pipe 71, and the oil supply and discharge hole 82, and is discharged to the outside of the outboard motor 1. Further, in a state where the outboard motor 1 is tilted forward after discharging the gear oil in the oil storage space R, the user can inject new gear oil into the oil storage space R from the outside of the outboard motor 1 using the oil pump by connecting the oil pump to the pump connecting portion 81. At this time, the gear oil discharged from the oil pump into the oil supply and discharge hole 82 sequentially flows through the oil supply and discharge hole 82, the first supply and discharge pipe 71, the second supply and discharge pipe 72, and the third supply and discharge pipe 73, and flows into the oil storage space R from the oil inlet and outlet 74.

As illustrated in FIG. 2, a small hole communicating with the oil storage space R is provided in an upper portion of a right surface of the lower case 5, in the vicinity of the pump connecting portion 81 (in the present embodiment, at a lower side of the gauge insertion portion 62), and a bolt 88 is fitted to the small hole so as to close the small hole. When sucking the gear oil stored in the oil storage space R, the bolt 88 is removed to introduce air into the oil storage space R through the small hole, or when injecting the gear oil into the oil storage space R, the bolt 88 is removed to discharge air from the oil storage space R through the small hole.

(Arrangement of Gauge Insertion Portion and Pump Connecting Portion)

Figure 9:
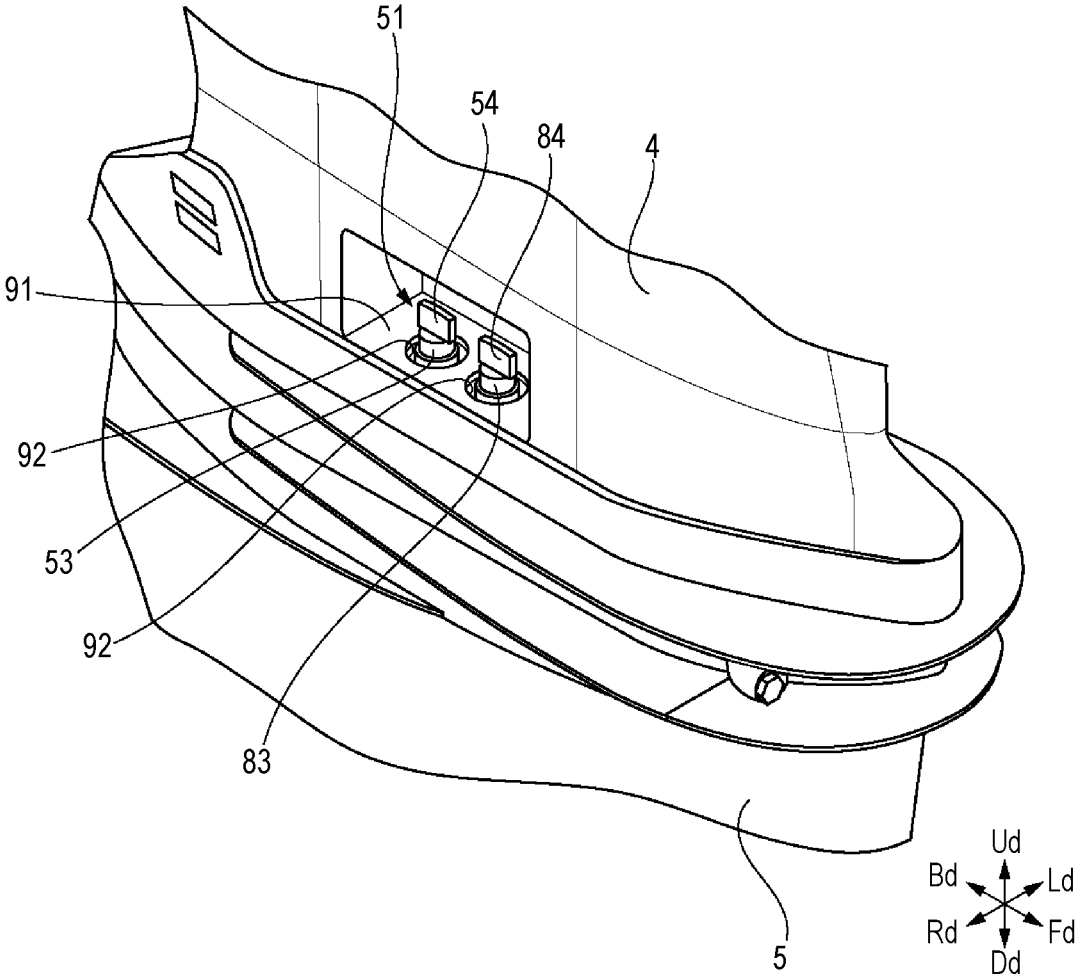
FIG. 9 is a perspective view illustrating the gear oil checking and replacement portion in the outboard motor according to the embodiment of the present disclosure.

FIG. 9 illustrates a gear oil checking and replacement portion 91. In the outboard motor 1, the gear oil checking and replacement portion 91 is a portion that is accessed when the user checks the level or the state of the gear oil stored in the oil storage space R or when the gear oil in the oil storage space R is to be replaced. As illustrated in FIG. 1, the gear oil checking and replacement portion 91 is provided at an intermediate portion in the front-rear direction of a right portion of a lower portion of the upper case 4. As illustrated in FIG. 9, the gear oil checking and replacement portion 91 is a recessed portion formed by recessing, toward the left side (an inner side in the left-right direction), an outer wall surface of the intermediate portion in the front-rear direction of the right portion of the lower portion of the upper case 4.

In the gear oil checking and replacement portion 91, the gauge insertion portion 62 and the pump connecting portion 81 are arranged side by side in the front-rear direction and adjacent to each other. Specifically, two insertion holes 92 are arranged side by side in the front-rear direction in a lower wall of the gear oil checking and replacement portion 91, and upper-end-side portions of the gauge insertion portion 62 and the pump connecting portion 81 provided in the lid member 7 of the lower case 5 protrude into the gear oil checking and replacement portion 91 through the two insertion holes 92 respectively. The plug 53 of the gear oil gauge 51 fitted in the gauge insertion hole 63 of the gauge insertion portion 62 and the plug 83 fitted in the oil supply and discharge hole 82 of the pump connecting portion 81 are located in the gear oil checking and replacement portion 91.

When checking the level or the state of the gear oil stored in the oil storage space R, the user can access the gear oil checking and replacement portion 91, pinch the tab 54 of the plug 53 in the gear oil checking and replacement portion 91 to pull out the gear oil gauge 51 from the gauge insertion portion 62, and check the level or the state of the gear oil. Further, when replacing the gear oil in the oil storage space R, the user can access the gear oil checking and replacement portion 91, pinch the tab 84 of the plug 83 in the gear oil checking and replacement portion 91 to remove the plug 83 from the pump connecting portion 81, and connect the oil pump to the pump connecting portion 81.

As described above, the outboard motor 1 of the embodiment of the present disclosure includes the gear oil gauge 51. Therefore, the user can easily check the level or the state of the gear oil stored in the oil storage space R by using the gear oil gauge 51. For example, the user can use the gear oil gauge 51 to check on a daily basis whether the gear oil needs to be replaced, and can finely manage the outboard motor 1. Accordingly, safety of navigation can be enhanced.

In the outboard motor 1 according to the present embodiment, the gauge insertion portion 62 and the pump connecting portion 81 are arranged side by side in the front-rear direction at the right portion of the upper portion of the lower case 5. Therefore, the user can perform insertion and removal of the gear oil gauge 51, connection of the oil pump, an operation on the oil pump, and the like when the user stays at one position on the right side of the outboard motor 1 or simply slightly moves on the right side of the outboard motor 1. For example, the user performs an operation of pulling out the gear oil gauge 51 from the gauge insertion portion 62, observing the gear oil adhered to the gear oil gauge 51, and checking the state of the gear oil stored in the oil storage space R. When the user determines, as a result, that the gear oil needs to be replaced, the user subsequently performs an operation of connecting the oil pump to the pump connecting portion 81, operating the oil pump to suck the oil in the oil storage space R, and discharging the oil to the outside of the outboard motor 1. According to the outboard motor 1 of the present embodiment, these operations can be sequentially performed from one position on the right side of the outboard motor 1. After the oil in the oil storage space R is discharged to the outside of the outboard motor 1, the user connects the oil pump to the pump connecting portion 81 and injects new gear oil into the oil storage space R using the oil pump. According to the outboard motor 1 of the present embodiment, the user can check an injection amount of the gear oil by using the gear oil gauge 51 while injecting the gear oil in a state of staying at one position on the right side of the outboard motor 1. In this way, according to the outboard motor 1 of the present embodiment, it is possible to easily and smoothly perform the checking of the state of the gear oil and the replacement of the gear oil.

In addition, according to the outboard motor 1 of the present embodiment, since the gauge insertion portion 62 and the pump connecting portion 81 are arranged so as to be adjacent to each other in the front-rear direction, the checking of the state of the gear oil and the replacement of the gear oil can be performed more smoothly.

Further, in the outboard motor 1 of the present embodiment, the gauge insertion portion 62 and the pump connecting portion 81 are disposed in the gear oil checking and replacement portion 91 provided at the intermediate portion in the front-rear direction of the right portion of the lower portion of the upper case 4. Therefore, the user can easily access the gauge insertion portion 62 when checking the level or the state of the gear oil, and can easily access the pump connecting portion 81 when replacing the gear oil. Unlike the outboard motor disclosed in Patent Literature 1, it is not necessary to remove the case of the outboard motor in order to replace the gear oil. Further, according to the outboard motor 1 of the present embodiment, since the gauge insertion portion 62 and the pump connecting portion 81 are disposed in the gear oil checking and replacement portion 91 provided at the intermediate portion in the front-rear direction of the right portion of the lower portion of the upper case 4, the gear oil can be replaced even in a state where the outboard motor 1 is mounted on a boat.

Further, as illustrated in FIG. 1, the gear oil checking and replacement portion 91 is disposed at an easily viewable portion in the outboard motor 1, and both the gauge insertion portion 62 and the pump connecting portion 81 are collectively arranged in the gear oil checking and replacement portion 91. Thus, the arrangement position of the gauge insertion portion 62 and the pump connecting portion 81 is easy to remember and hard to forget for the user.

The gear oil checking and replacement portion 91 is a recessed portion formed by recessing the outer wall surface of the upper case 4, and the gauge insertion portion 62 and the pump connecting portion 81 are arranged in the recessed gear oil checking and replacement portion 91. Accordingly, it is possible to prevent flowing water or foreign matter from hitting the gauge insertion portion 62 or the pump connecting portion 81 during sailing of the boat.

In the outboard motor 1 of the present embodiment, the gear oil gauge 51 is mounted to the lower case 5 in a bent state. Therefore, the gear oil gauge 51 can be mounted to a small region of a part of the lower case 5 in a state where the lower end portion of the gear oil gauge 51 is immersed in the gear oil stored in the oil storage space R. Therefore, the gear oil gauge 51 can be mounted to the lower case 5 without significantly changing the layout of other components provided in the lower case 5.

Further, in the outboard motor 1 of the present embodiment, a lower end portion of the oil supply and discharge passage 70, specifically, the lower end portion of the third supply and discharge pipe 73 is located at the front lower corner portion of the oil storage space R. The front lower corner portion of the oil storage space R is located at the lowermost position of the oil storage space R when the outboard motor 1 is tilted forward by a predetermined tilt angle as described above. Therefore, by sucking the gear oil in the oil storage space R in a state where the outboard motor 1 is tilted forward by a predetermined tilt angle, the gear oil in the oil storage space R can be substantially completely sucked and discharged to the outside of the outboard motor 1.

In the above-described embodiment, the gear oil gauge 51, the gauge mounting hole 61, the gauge insertion portion 62, the pump connecting portion 81, and the like are provided at the right portion of the upper portion of the lower case 5. Alternatively, these components may be provided at a left portion of the upper portion of the lower case 5. Further, in the above-described embodiment, the gear oil checking and replacement portion 91 is disposed in the lower portion of the upper case 4. Alternatively, the gear oil checking and replacement portion 91 may be disposed in the upper portion of the lower case 5. Further, in the above-described embodiment, the gauge insertion portion 62 and the pump connecting portion 81 are arranged so as to be adjacent to each other. Alternatively, the gauge insertion portion 62 and the pump connecting portion 81 may not be adjacent to each other, and for example, another component may be provided between the gauge insertion portion 62 and the pump connecting portion 81. Further, the present disclosure is not limited to an outboard motor of a contra-rotating propeller type, and can be applied to various outboard motors.

The present disclosure can be modified as appropriate without departing from the gist or idea of the disclosure which can be read from the claims and the entire specification, and the outboard motor to which this modification is applied is also included in the technical idea of the present disclosure.

What is claimed is:

1. An outboard motor for propelling a boat, the outboard motor comprising:

a power source disposed at an upper portion of the outboard motor;

a propeller shaft disposed at a lower portion of the outboard motor, to which a propeller is mounted;

a drive shaft provided between the power source and the propeller shaft and configured to be rotated by a rotational output of the power source;

a gear mechanism disposed at the lower portion of the outboard motor and configured to transmit rotation of the drive shaft to the propeller shaft;

a lower case disposed at the lower portion of the outboard motor and having an internal space in which the gear mechanism is accommodated and in which gear oil for lubricating the gear mechanism is stored;

a gear oil gauge configured to check a level or a state of the gear oil stored in the internal space;

a gauge mounting hole provided in the lower case and configured to removably mount the gear oil gauge to the lower case such that one end side of the gear oil gauge is immersed in the gear oil stored in the internal space;

a gauge insertion portion configured to insert the gear oil gauge into the gauge mounting hole;

an oil supply and discharge passage provided in the lower case and configured to discharge gear oil from an inside of the internal space to an outside of the outboard motor or to supply gear oil from the outside of the outboard motor to the inside of the internal space; and a pump connecting portion configured to connect a pump, which is configured to supply and discharge gear oil, and the oil supply and discharge passage, wherein the gauge insertion portion and the pump connecting portion are arranged side by side in a front-rear direction at one side portion in a left-right direction of an upper portion of the lower case.

2. The outboard motor according to claim 1, wherein the gauge insertion portion and the pump connecting portion are arranged so as to be adjacent to each other in the front-rear direction.

3. The outboard motor according to claim 1, wherein the gauge insertion portion and the pump connecting portion are arranged in a recessed portion formed by recessing, toward an inner side in a left-right direction, an outer wall surface of one side portion in the left-right direction of a lower portion of an upper case connected to the lower case or an outer wall surface of one side portion in the left-right direction of an upper portion of the lower case.

4. The outboard motor according to claim 1, wherein the gear oil gauge is mounted to the lower case in a bent state.

5. The outboard motor according to claim 1, wherein a lower end portion of the oil supply and discharge passage is located at a front lower corner portion of the internal space.

* * * * *